US011804646B2

(12) United States Patent
Kim et al.

(10) Patent No.: US 11,804,646 B2
(45) Date of Patent: Oct. 31, 2023

(54) ANTENNA STRUCTURE AND IMAGE DISPLAY DEVICE INCLUDING THE SAME

(71) Applicants: DONGWOO FINE-CHEM CO., LTD., Jeollabuk-do (KR); KREEMO INC., Seoul (KR)

(72) Inventors: Jong Min Kim, Gyeonggi-do (KR); Dong Pil Park, Incheon (KR); Won Hee Lee, Gyeonggi-do (KR); In Seok Jang, Gyeonggi-do (KR); Beak Jun Seong, Gyeonggi-do (KR); Jung Woo Lee, Seoul (KR); Seong Tae Jeong, Gyeonggi-do (KR); In Kyung Hong, Seoul (KR); John Joonho Park, Gyeonggi-do (KR)

(73) Assignees: DONGWOO FINE-CHEM CO., LTD., Jeollabuk-Do (KR); KREEMO INC., Seoul (KR)

( * ) Notice: Subject to any disclaimer, the term of this patent is extended or adjusted under 35 U.S.C. 154(b) by 0 days.

(21) Appl. No.: 17/672,951

(22) Filed: Feb. 16, 2022

(65) Prior Publication Data

US 2022/0263224 A1 Aug. 18, 2022

(30) Foreign Application Priority Data

Feb. 16, 2021 (KR) ..... 10-2021-0020584

(51) Int. Cl.
*H01Q 1/22* (2006.01)
*H01Q 5/10* (2015.01)
(Continued)

(52) U.S. Cl.
CPC ..... *H01Q 1/2283* (2013.01); *H01Q 5/10* (2015.01); *H01Q 5/385* (2015.01); *H01Q 19/09* (2013.01)

(58) Field of Classification Search
CPC ..... H01Q 1/2283; H01Q 5/10; H01Q 5/385; H01Q 19/09; H01Q 1/1271; H01Q 1/364; H01Q 9/045; H01Q 21/08; H01Q 21/24; H01Q 1/243; H01Q 1/50; H01Q 1/38; H01Q 5/28
(Continued)

(56) References Cited

FOREIGN PATENT DOCUMENTS

CN 114696079 A * 7/2022
EP 4080680 A1 * 10/2022 ..... H01Q 1/24
(Continued)

OTHER PUBLICATIONS

Silva, A. N., Paiva, H. F., Barros, J. J., Lemos, N. A., & da Silva Junior, P. F. (2014). Fourleaf clover UWB planar monopole antenna. (Year: 2014).*

*Primary Examiner* — Dimary S Lopez Cruz
*Assistant Examiner* — Brandon Sean Woods
(74) *Attorney, Agent, or Firm* — The PL Law Group, PLLC

(57) ABSTRACT

An antenna structure according to an embodiment of the present disclosure includes a dielectric layer, and an antenna conductive layer disposed on a top surface of the dielectric layer. The antenna conductive layer includes a radiator, first and second transmission lines extending in different directions to be connected to the radiator, an upper parasitic element adjacent to an upper portion of the radiator in a planar view, and a lower parasitic element adjacent to a lower portion of the radiator, the first transmission line and the second transmission line in the planar view.

18 Claims, 8 Drawing Sheets

(51) Int. Cl.
*H01Q 5/385* (2015.01)
*H01Q 19/09* (2006.01)

(58) Field of Classification Search
USPC ..... 343/720
See application file for complete search history.

(56) References Cited

FOREIGN PATENT DOCUMENTS

| | | | |
|---|---|---|---|
| KR | 10-2000-0019433 | A | 4/2000 |
| KR | 10-2001-0068154 | A | 7/2001 |
| KR | 10-2011-0053509 | A | 5/2011 |
| KR | 10-2019-0009232 | A | 1/2019 |
| KR | 10-2020-0098740 | A | 8/2020 |

* cited by examiner

ANTENNA STRUCTURE AND IMAGE DISPLAY DEVICE INCLUDING THE SAME

CROSS-REFERENCE TO RELATED APPLICATION

This application claims priority to Korean Patent Application No. 10-2021-0020584 filed on Feb. 16, 2021 in the Korean Intellectual Property Office (KIPO), the disclosure of which is herein incorporated by reference in its entirety.

BACKGROUND

1. Field

The present invention relates to an antenna structure and an image display device including the same. More particularly, the present invention relates to an antenna structure including an antenna conductive layer and a dielectric layer, and an image display device including the same.

2. Description of the Related Art

As information technologies have been developed, a wireless communication technology such as Wi-Fi, Bluetooth, etc., is combined with an image display device in, e.g., a smartphone form. In this case, an antenna may be combined with the display device to provide a communication function.

As mobile communication technologies has been recently developed, an antenna for performing, e.g., communications in high-frequency or ultra-high frequency band may be coupled to the image display device.

For example, as various functional devices are included in the image display device, an expanded frequency coverage of the antenna for a transmission/reception of various signals is required. Further, when the antenna has a plurality of polarization, radiation efficiency may be increased and an antenna coverage may be further increased.

However, when a driving frequency of the antenna increases, a signal loss may also increase. As a signal transmission path becomes increased, an antenna gain may be decreased. Additionally, as described above, when the radiation coverage of the antenna increases, a radiation density or the antenna gain may be reduced to degrade radiation efficiency/reliability.

Further, a construction of an antenna that has multi-polarization and broadband properties and provides a high gain in a limited space of the image display device may not be easily implemented.

For example, Korean Published Patent Application No. 2019-0009232 discloses an antenna module integrated into a display panel.

SUMMARY

According to an aspect of the present invention, there is provided an antenna structure having improved radiation property and spatial efficiency.

According to an aspect of the present invention, there is provided an image display device including an antenna structure with improved radiation property and spatial efficiency.

(1) An antenna structure, including: a dielectric layer; and an antenna conductive layer disposed on a top surface of the dielectric layer, wherein the antenna conductive layer includes: a radiator; first and second transmission lines extending in different directions to be connected to the radiator; an upper parasitic element adjacent to an upper portion of the radiator in a planar view; and a lower parasitic element adjacent to a lower portion of the radiator, the first transmission line and the second transmission line in the planar view.

(2) The antenna structure of the above (1), wherein the radiator has convex portions and concave portions, and the first transmission line and the second transmission line are connected to different concave portions of the concave portions.

(3) The antenna structure of the above (2), wherein the first transmission line includes a first feeding portion and a first bent portion extending from the first feeding portion to be connected to the radiator, and the second transmission line includes a second feeding portion and a second bent portion extending from the second feeding portion to be connected to the radiator.

(4) The antenna structure of the above (3), wherein an angle between the first bent portion and the second bent portion is 90°.

(5) The antenna structure of the above (3), wherein the first feeding portion and the second feeding portion serve as antenna ports to which feeding signals of different phases are applied.

(6) The antenna structure of the above (5), wherein a phase difference between the feeding signals applied to the first feeding portion and the second feeding portion is from 160° to 200°.

(7) The antenna structure of the above (1), wherein the upper parasitic element includes a first upper parasitic element and a second upper parasitic element separated from each other.

(8) The antenna structure of the above (7), wherein the radiator has convex portions and concave portions, and the first upper parasitic element and the second upper parasitic element are disposed to be adjacent to different concave portions of the concave portions.

(9) The antenna structure of the above (8), wherein the first upper parasitic element and the second upper parasitic element face each other with a convex portion at an upper portion of the radiator among the convex portions interposed therebetween.

(10) The antenna structure of the above (1), wherein the lower parasitic element includes a first lateral parasitic element adjacent to the first transmission line, and a second lateral parasitic element adjacent to the second transmission line.

(11) The antenna structure of the above (10), wherein the lower parasitic element further includes a central parasitic element disposed between the first transmission line and the second transmission line, and the first lateral parasitic element is separated from the central parasitic element with the first transmission line interposed therebetween, and the second lateral parasitic element is separated from the central parasitic element with the second transmission line interposed therebetween.

(12) The antenna structure of the above (11), wherein the first lateral parasitic element includes: a first parasitic body facing the central parasitic element with the first transmission line interposed therebetween; a first parasitic extension portion protruding from the first parasitic body; and a first parasitic bent portion extending from the first parasitic extension portion toward the radiator, wherein the second lateral parasitic element includes: a second parasitic body facing the central parasitic element with the second transmission line interposed therebetween; a second parasitic extension portion protruding from the second parasitic body; and a second parasitic bent portion extending from the second parasitic extension portion toward the radiator.

(13) The antenna structure of the above (12), wherein the radiator has a mesh structure, and the central parasitic element, the first parasitic body and the second parasitic body have a solid structure.

(14) The antenna structure of the above (13), wherein a portion of the first transmission line between the central parasitic element and the first parasitic body has a solid structure, and a remaining portion of the first transmission line has a mesh structure; and a portion of the second transmission line between the central parasitic element and the second parasitic body has a solid structure, and a remaining portion of the second transmission line has a mesh structure.

(15) The antenna structure of the above (12), wherein the radiator has a mesh structure, and each of the central parasitic element, the first parasitic body and the second parasitic body includes a mesh portion and a solid portion.

(16) The antenna structure of the above (1), wherein the radiator has a four-leaf clover shape or a cross shape.

(17) The antenna structure of the above (1), wherein the radiator, the first transmission line, the second transmission line, the upper parasitic element and the lower parasitic element are all arranged at the same level on the top surface of the dielectric layer.

(18) An image display device, including: a display panel; and the antenna structure according to embodiments as described above of claim 1 disposed on the display panel.

(19) The image display device of the above (18), further including: an intermediate circuit board including feeding lines electrically connected to the first transmission line and the second transmission line of the antenna structure; a chip mounting board disposed under the display panel; and an antenna driving integrated circuit chip mounted on the chip mounting board to apply a feeding signal to the feeding lines included in the intermediate circuit board.

According to embodiments of the present invention, and antenna structure may include a radiator including a plurality of convex portions and concave portions, and may include a plurality of transmission lines connected to the radiator in different directions. A plurality of polarization directions and coverage of a plurality of frequency bands may be substantially provided by the combination of the radiator and the transmission line.

In exemplary embodiments, two, three or more resonance frequencies may be implemented from the antenna structure. For example, a triple-band antenna may be implemented from the antenna structure.

In exemplary embodiments, a parasitic element may be arranged around the radiator and the transmission line. For example, the parasitic element may include a lower parasitic element disposed around the transmission line and an upper parasitic element adjacent to an upper portion of the radiator. A formation of a plurality of the resonance frequencies may be promoted by the parasitic element, so that a substantially effective triple-band antenna may be achieved.

DETAILED DESCRIPTION

According to exemplary embodiments of the present invention, there is provided an antenna structure including a combination of radiator and a parasitic element to provide multi-frequency and polarization properties.

The antenna structure may be, e.g., a microstrip patch antenna fabricated in the form of a transparent film. The antenna structure may be applied to communication devices for a high or ultrahigh frequency band corresponding to a mobile communication of, e.g., 3G, 4G, 5G or more.

According to exemplary embodiments of the present invention, there is also provided an image display device including the antenna structure. An application of the antenna structure may not be limited to the image display device, and the antenna structure may be applied to various objects or structures such as a vehicle, a home electronic appliance, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
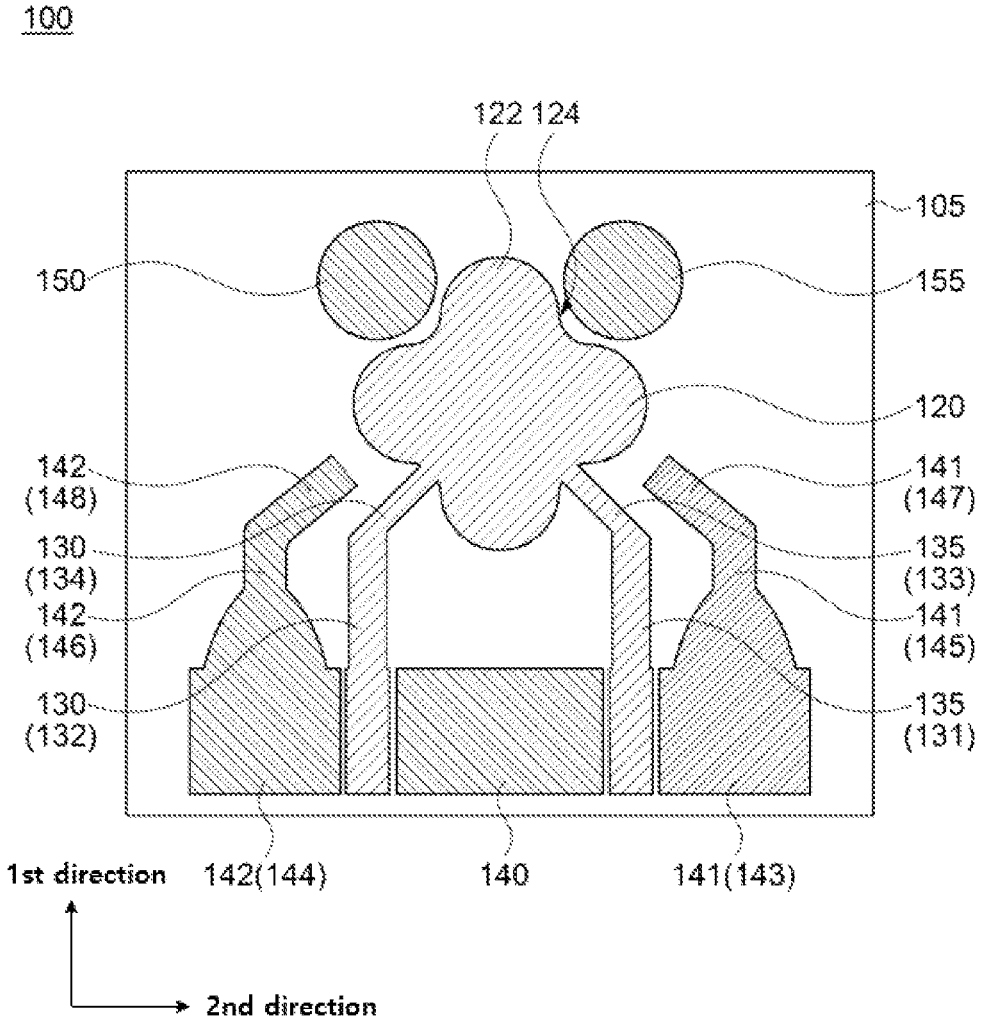
FIG. 1 is a schematic top planar view illustrating an antenna structure according to exemplary embodiments.

FIG. 1 is a schematic top planar view illustrating an antenna structure according to exemplary embodiments.

In FIG. 1, two directions parallel to a top surface of a dielectric layer 105 and perpendicular to each other are defined as a first direction and a second direction. For example, the first direction may correspond to a length direction of the antenna structure, and the second direction may correspond to a width direction of the antenna structure. The definitions of the first direction and the second direction may be equally applied to all accompanying drawings.

Referring to FIG. 1, the antenna device 100 may include an antenna conductive layer 110 (see FIG. 6) formed on an upper surface of the dielectric layer 105.

The dielectric layer 105 may include, e.g., a transparent resin material. For example, the dielectric layer 105 may include a polyester-based resin such as polyethylene terephthalate, polyethylene isophthalate, polyethylene naphthalate and polybutylene terephthalate; a cellulose-based resin such as diacetyl cellulose and triacetyl cellulose; a polycarbonate-based resin; an acrylic resin such as polymethyl (meth)acrylate and polyethyl (meth)acrylate; a styrene-based resin such as polystyrene and an acrylonitrile-styrene copolymer; a polyolefin-based resin such as polyethylene, polypropylene, a cycloolefin or polyolefin having a norbornene structure and an ethylene-propylene copolymer; a vinyl chloride-based resin; an amide-based resin such as nylon and an aromatic polyamide; an imide-based resin; a polyethersulfone-based resin; a sulfone-based resin; a polyether ether ketone-based resin; a polyphenylene sulfide resin; a vinyl alcohol-based resin; a vinylidene chloride-based resin; a vinyl butyral-based resin; an allylate-based resin; a polyoxymethylene-based resin; an epoxy-based resin; a urethane or acrylic urethane-based resin; a silicone-based resin, etc. These may be used alone or in a combination of two or more thereof.

In some embodiments, an adhesive film such as an optically clear adhesive (OCA), an optically clear resin (OCR), etc., may be included in the dielectric layer 105.

In some embodiments, the dielectric layer 105 may include an inorganic insulating material such as silicon oxide, silicon nitride, silicon oxynitride, glass, or the like.

In an embodiment, the dielectric layer 105 may be provided as a substantially single layer. In an embodiment, the dielectric layer 105 may include a multi-layered structure of at least two or more layers.

Capacitance or inductance may be formed between the antenna conductive layer 110 and a ground layer 90 (see FIG. 6) by the dielectric layer 105, so that a frequency band for operating or driving the antenna structure may be adjusted. In some embodiments, a dielectric constant of the dielectric layer 105 may be adjusted in a range from about 1.5 to 12. If the dielectric constant exceeds about 12, a driving frequency may be excessively reduced, and driving in a desired high frequency or ultra-high frequency band may not be implemented.

The antenna conductive layer 110 may include a radiator 120, a transmission line and a parasitic element.

In exemplary embodiments, the radiator 120 or a boundary of the radiator 120 may include a plurality of convex portions 122 and concave portions 124. The convex portions 122 and the concave portions 124 may have curved shapes.

In exemplary embodiments, the convex portions 122 and the concave portions 124 may be alternately and repeatedly arranged along a profile of the radiator 122 in a planar view.

In some embodiments, the radiator 120 may include four convex portions 122 and may include four concave portions 124.

As illustrated in FIG. 1, the radiator 120 may have a curved cross shape. For example, the radiator 120 may have a substantially four-leaf clover shape.

In exemplary embodiments, a plurality of transmission lines may be connected to one radiator 120. In some embodiments, a first transmission line 130 and a second transmission line 135 may be connected to the radiator 120. For example, the transmission lines may be provided as a single member substantially integral with the radiator 120.

The first transmission line 130 and the second transmission line 135 may be symmetrical to each other. For example, the first transmission line 130 and the second transmission line 135 may be disposed to be symmetrical to each other with respect to on a central line of the radiator 120 in the first direction.

Each of the transmission lines may include a feeding portion and a bent portion. The first transmission line 130 may include a first feeding portion 132 and a first bent portion 134, and the second transmission line 135 may include a second feeding portion 131 and a second bent portion 133.

Figure 7:
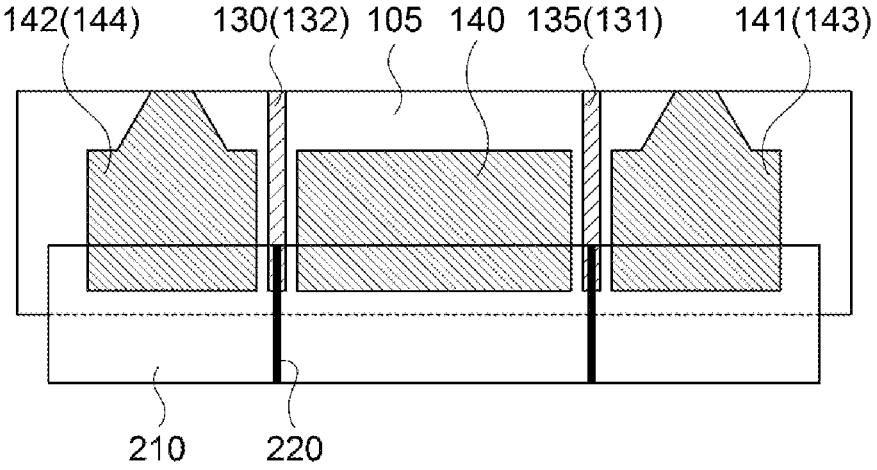
FIG. 7 is a schematic partially enlarged top planar view for describing an antenna package according to exemplary embodiments.

Each of the first feeding portion 132 and the second feeding portion 131 may be electrically connected to a feeding line included in a circuit board such as, e.g., a flexible printed circuit board (FPCB) (see FIG. 7). In some embodiments, the first feeding portion 132 and the second feeding portion 131 may extend in the first direction. The first feeding portion 132 and the second feeding portion 131 may be substantially parallel to each other.

The first bent portion 134 and the second bent portion 133 may be bent in a direction to the radiator 120 from the first feeding portion 132 and the second feeding portion 131, respectively, and may be directly connected or contact with the radiator 120.

The first bent portion 134 and the second bent portion 133 may extend in different directions from each other to be connected with the radiator 122. In some embodiments, an angle between extending directions of the first bent portion 134 and the second bent portion 133 may be substantially about 90°.

For example, the first bent portion 134 may be inclined by 45° in a clockwise direction with respect to the first direction. The second bent portion 133 may be inclined by 45° counterclockwise with respect to the first direction.

According to the construction and arrangement of the bent portions 133 and 134 as described above, a feeding may be performed in two directions substantially orthogonal to the radiator 120 through the first transmission line 130 and the second transmission line 135. Accordingly, a dual polarization property may be implemented from one radiator 120.

For example, both vertical radiation and horizontal radiation properties may be implemented from the radiator 120.

In some embodiments, the bent portions 133 and 134 may be connected to the concave portions 124 of the radiator 120. As illustrated in FIG. 1, the first bent portion 134 and the second bent portion 133 may each be connected to different concave portions 124.

In an embodiment, the first bent portion 134 and the second bent portion 133 may be connected to concave portions formed at a lower portion with respect to a central line in the second direction of the radiator 122 among four concave portions 124. The term "lower" used herein may refer to a portion or a region adjacent to the feeding portions 131 and 132 with respect to the central line extending in the second direction of the radiator 122 in the planar view.

The antenna structure 100 according to exemplary embodiments may include parasitic elements physically separated from the radiator 120 and the transmission lines 130 and 135.

The parasitic elements may include lower parasitic elements 140, 141 and 142 adjacent to the transmission line and upper parasitic elements 150 and 155 adjacent to the radiator 120.

The lower parasitic elements 140, 141 and 142 may be located below the central line extending in the second direction of the radiator 122 and disposed around the transmission lines 130 and 135. The lower parasitic elements 140, 141 and 142 may include a central parasitic element 140, a first lateral parasitic element 142 and a second lateral parasitic element 141. In some embodiments, the central parasitic element 140 may be omitted.

The central parasitic element 140 may be disposed between the first transmission line 130 and the second transmission line 135. In an embodiment, the central parasitic element 140 may be disposed between the first feeding portion 132 and the second feeding portion 131.

The first lateral parasitic element 142 and the second lateral parasitic element 141 may be adjacent to both lateral sides of the central parasitic element 140. The first lateral parasitic element 142 may include a first parasitic body 144, a first parasitic extension portion 146 and a first parasitic bent portion 148. The second lateral parasitic element 141 may include a second parasitic body 143, a second parasitic extension portion 145 and a second parasitic bent portion 147.

The first parasitic body 144 may face the central parasitic element 140 with the first transmission line 130 interposed therebetween. The second parasitic body 143 may face the central parasitic element 140 with the second transmission line 135 interposed therebetween.

The first parasitic extension portion 146 and the second parasitic extension portion 145 may protrude from the first parasitic body 144 and the second parasitic body 143, respectively. The first parasitic extension portion 146 and the second parasitic extension portion 145 may extend in the first direction.

The first parasitic bent portion 148 and the second parasitic bent portion 147 may extend from terminal ends of the first parasitic extension portion 146 and the second parasitic extension portion 145, respectively, toward the radiator 120. In an embodiment, the first parasitic bent portion 148 and the second parasitic bent portion 147 may be substantially parallel to the first bent portion 134 and the second bent portion 133, respectively.

The upper parasitic elements 150 and 155 may be disposed around an upper portion of the radiator 120 with respect to the central line in the second direction of the radiator. The term "upper" used herein may refer to a portion or a region that may be away from the feeding portions 131 and 132 or opposite to the feeding portions 131 and 132 with respect to the central line extending in the second direction of the radiator 120 in the planar view.

The upper parasitic elements 150 and 155 may be adjacent to the radiator 120. In exemplary embodiments, the upper parasitic elements 150 and 155 may be adjacent to the concave portions 124 included in the upper portion of the radiator 120.

For example, the upper parasitic elements 150 and 155 may be partially disposed in recesses formed by the concave portions 124.

The upper parasitic element may include a first upper parasitic element 150 and a second upper parasitic element 155. The first upper parasitic element 150 and the second upper parasitic element 155 may be disposed around different concave portions 124 of the radiator 120.

In some embodiments, the first upper parasitic element 150 and the second upper parasitic element 155 may face each other with the convex portion 122 included in the upper portion of the radiator 120 interposed therebetween.

In an embodiment, the first upper parasitic element 150 and the second upper parasitic element 155 may have a substantially circular shape. However, the shape of the first upper parasitic element 150 and the second upper parasitic element 155 may be properly changed (e.g., an elliptical shape or a polygonal shape) according to a shape of the radiator 120.

According to the above-described exemplary embodiments, the shape of the radiator 120 may be formed to include the convex portion 122 and the concave portion 124, and the first and second transmission lines 130 and 135 may be connected to different concave portions 124 of the radiator 120.

The dual polarization property may be implemented from the radiator 120 by the above-described dual transmission line structure.

In some embodiments, feeding signals having different phases may be applied to the first and second transmission lines 130 and 135, respectively. For example, a first feeding signal and a second feeding signal having a phase difference of about 160° to 200°, preferably 180°, may be applied to the first and second transmission lines 130 and 135, respectively.

The phase difference signal application, the dual transmission line structure, and the shape of the radiator 120 may be combined so that the antenna structure 100 may be provided as a broadband antenna of a multi-resonance frequency band.

The parasitic elements may serve as floating elements that may not be connected to other conductors, and may be disposed to be adjacent to the radiator 120 and the transmission lines 130 and 135 to promote a formation of each band of multiple resonance frequencies implemented by the antenna structure 100.

Different resonance frequency bands may be distinguished by the parasitic elements, so that the antenna structure 100 may serve as a substantially multi-band antenna. Further, the lower parasitic elements 140, 141 and 142 may be disposed around the transmission lines 130 and 135, and the upper parasitic elements 150 and 155 may be disposed around to the upper portion of the radiator 120. Accordingly, signal enhancement and multi-band formation may be implemented both in a low-frequency band and a high-frequency band.

In some embodiments, the antenna structure 100 may serve as a triple band antenna. For example, three resonance frequency peaks in a range from 10 GHz to 40 GHz or from 20 GHz to 40 GHz may be provided from the antenna structure 100.

In an embodiment, a first resonance frequency peak in a range from 20 GHz to 25 GHz, a second resonance frequency peak in a range from 27 GHz to 35 GHz, and a third resonance frequency peak in a range from 35 GHz to 40 GHz may be implemented from the antenna structure 100.

The antenna conductive layer 110 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy containing at least one of the metals. These may be used alone or in combination thereof.

In an embodiment, the antenna conductive layer 110 may include silver (Ag) or a silver alloy (e.g., silver-palladium-copper (APC)), or copper (Cu) or a copper alloy (e.g., a copper-calcium (CuCa)) to implement a low resistance and a fine line width pattern.

In some embodiments, the antenna conductive layer 110 may include a transparent conductive oxide such as indium tin oxide (ITO), indium zinc oxide (IZO), zinc oxide (ZnOx), indium zinc tin oxide (IZTO), etc.

In some embodiments, the antenna conductive layer 110 may include a stacked structure of a transparent conductive oxide layer and a metal layer. For example, the antenna unit may include a double-layered structure of a transparent conductive oxide layer-metal layer, or a triple-layered structure of a transparent conductive oxide layer-metal layer-transparent conductive oxide layer. In this case, flexible property may be improved by the metal layer, and a signal transmission speed may also be improved by a low resistance of the metal layer. Corrosive resistance and transparency may be improved by the transparent conductive oxide layer.

In an embodiment, the antenna conductive layer 110 may include a metamaterial.

In some embodiments, the antenna conductive layer 110 may include a blackened portion, so that a reflectance at a surface of the antenna conductive layer 110 may be decreased to suppress a visual pattern recognition due to a light reflectance.

In an embodiment, a surface of the metal layer included in the antenna conductive layer 110 may be converted into a metal oxide or a metal sulfide to form a blackened layer. In an embodiment, a blackened layer such as a black material coating layer or a plating layer may be formed on the antenna conductive layer 110 or the metal layer. The black material or plating layer may include silicon, carbon, copper, molybdenum, tin, chromium, molybdenum, nickel, cobalt, or an oxide, sulfide or alloy containing at least one therefrom.

A composition and a thickness of the blackened layer may be adjusted in consideration of a reflectance reduction effect and an antenna radiation property.

The radiator 120, the transmission lines 130 and 135, and the parasitic elements 140, 141, 142, 150 and 155 may all be disposed at the same level or at the same layer on a top surface of the dielectric layer 105. In an embodiment, the radiator 120, the transmission lines 130 and 135, and the parasitic elements 140, 141, 142, 150 and 155 may be formed by patterning the same conductive layer.

In some embodiments, the ground layer 90 (see FIG. 6) may be disposed on a lower surface of the dielectric layer 105. The ground layer 90 may be disposed to overlap the radiator 120.

In some embodiments, a conductive member of an image display device or a display panel 405 to which the antenna structure 100 is applied may serve as the ground layer 90.

The conductive member may include various electrodes or wirings such as, e.g., a gate electrode, a source/drain electrode, a pixel electrode, a common electrode, a scan line, a data line, etc., included in a thin film transistor (TFT) array panel.

In an embodiment, a metallic member disposed at a rear portion of the image display device such as a SUS plate, a sensor member (e.g., a digitizer), a heat dissipation sheet, etc., may serve as the ground layer 90.

Figure 2:
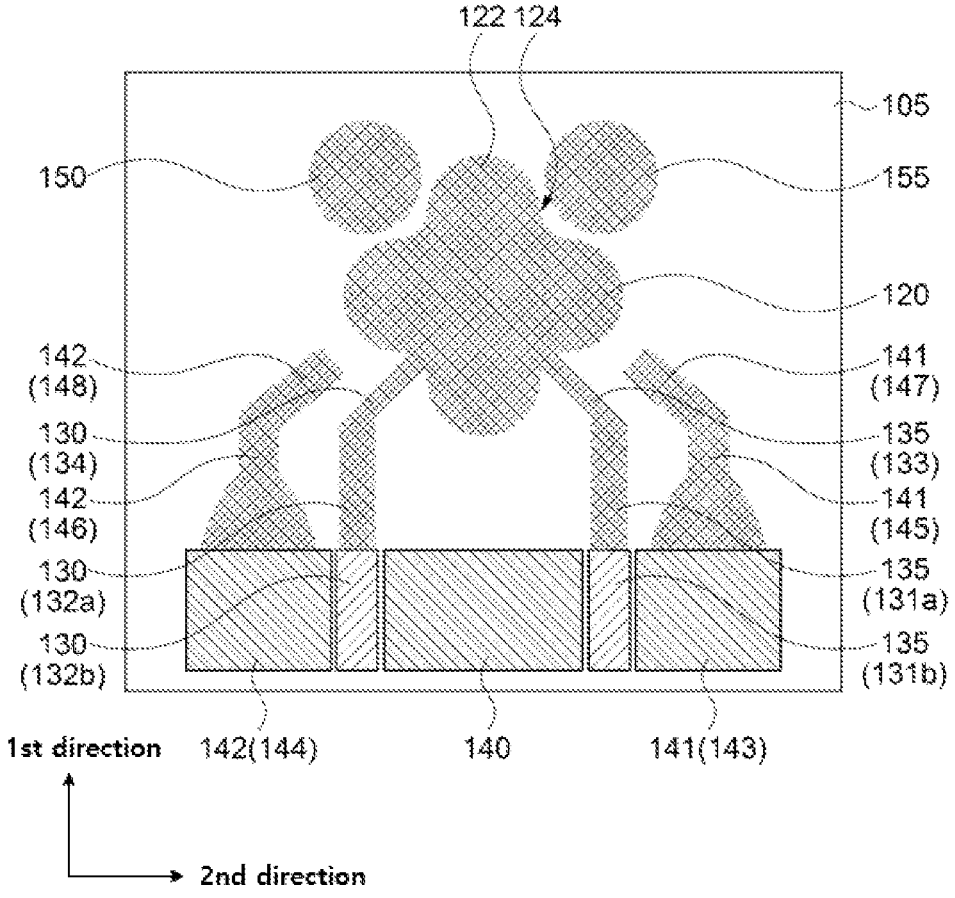
FIGS. 2 and 3 are schematic top planar views illustrating an antenna structure according to some exemplary embodiments.
Figure 3:
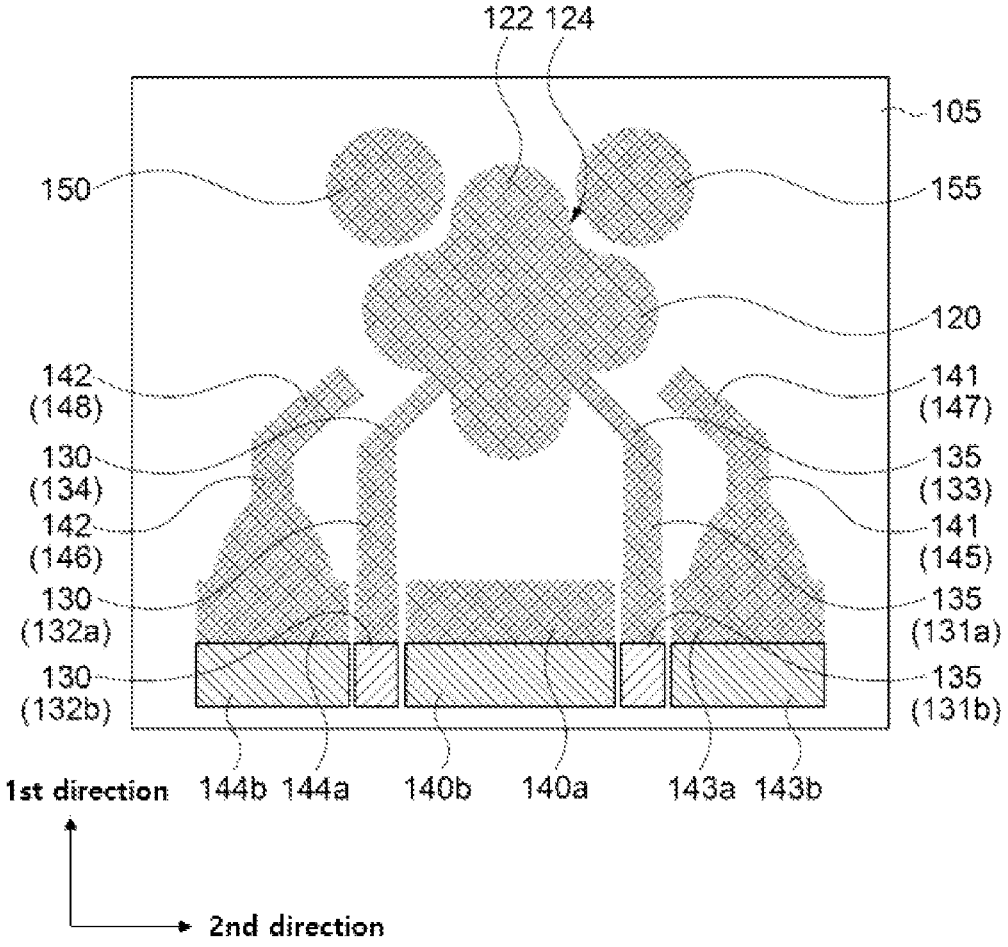

FIGS. 2 and 3 are schematic top planar views illustrating an antenna structure according to some exemplary embodiments. Detailed descriptions on elements and structures substantially the same as or similar to those described with reference to FIG. 1 are omitted herein.

Referring to FIG. 2, the antenna conductive layer 110 may include a mesh structure. In exemplary embodiments, the radiator 120 and the upper parasitic elements 150 and 155 may entirely include a mesh structure.

In some embodiments, the transmission lines 130 and 135 and the lower parasitic elements 140, 141 and 142 may partially include a mesh structure.

For example, the central parasitic element 140 and the parasitic bodies 143 and 144 of the lateral parasitic elements may be a solid pattern. The feeding portions 131 and 132 of the transmission lines 130 and 135 may partially include a mesh structure.

In an embodiment, the first feeding portion 132 may include a first mesh portion 132*a* and a first solid portion 132*b*. The second feeding portion 131 may include a second mesh portion 131*a* and a first solid portion 131*b*.

The first solid portion 132*b* may be disposed between the central parasitic element 140 having a solid structure and the first parasitic body 144. The second solid portion 131*b* may be disposed between the central parasitic element 140 having the solid structure and the second parasitic body 143.

Remaining portions of the lateral parasitic elements 141 and 142 except for the parasitic bodies 143 and 144 may have the mesh structure. Remaining portions of the transmission lines 130 and 135 except for the solid portions 131*b* and 132*b* may have the mesh structure.

For example, portions of the antenna conductive layer 110 having the mesh structure may be disposed in a display area of the image display device. Accordingly, a transmittance through the antenna conductive layer 110 may be improved to prevent deterioration of image quality from the image display device.

In an embodiment, a dummy mesh pattern (not illustrated) may be formed around the antenna conductive layer 110 in the display area to enhance a pattern structure uniformity and prevent the antenna conductive layer 110 from being visually recognized by a user.

The portions of the antenna conductive layer 110 having the solid structure may be disposed in a light-shielding area or a bezel area of the image display device. Accordingly, a feeding efficiency may be improved by using a low-resistance solid metal layer, and the formation of multiple bands may be promoted by the lower parasitic elements 140, 141 and 142.

Referring to FIG. 3, the central parasitic element 140 and the parasitic bodies 143 and 144 may also partially include a mesh structure.

The central parasitic element 140 may include a mesh element portion 140*a* and a solid element portion 140*b*. The first parasitic body 144 may include a first mesh body 144*a* and a second solid body 144*b*. The second parasitic body 143 may include a second mesh body 143*a* and a second solid body 143*b*.

A length of a mesh portion may also be extended in the feeding portions 131 and 132 of the transmission lines 130 and 135. For example, a first mesh portion 132*a* may be positioned between the first mesh body 144*a* and the mesh element portion 140*a*. A second mesh portion 131*a* may be positioned between the second mesh body 143*a* and the mesh element portion 140*a*.

For example, when the bezel area is reduced and the display area is expanded in the image display device, the central parasitic element 140 and the parasitic bodies 143 and 144 may also partially include the mesh structure to improve optical properties.

Figure 4:
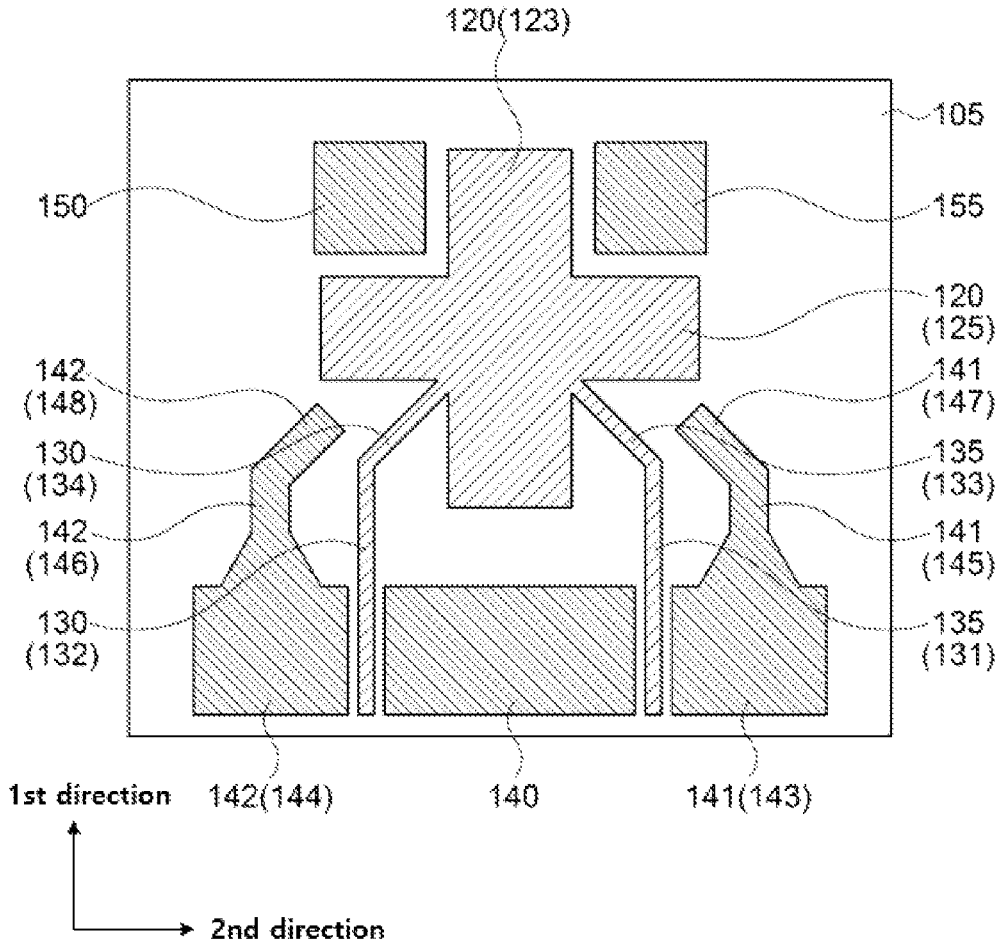
FIGS. 4 and 5 are schematic top planar views illustrating an antenna structure according to some exemplary embodiments.
Figure 5:
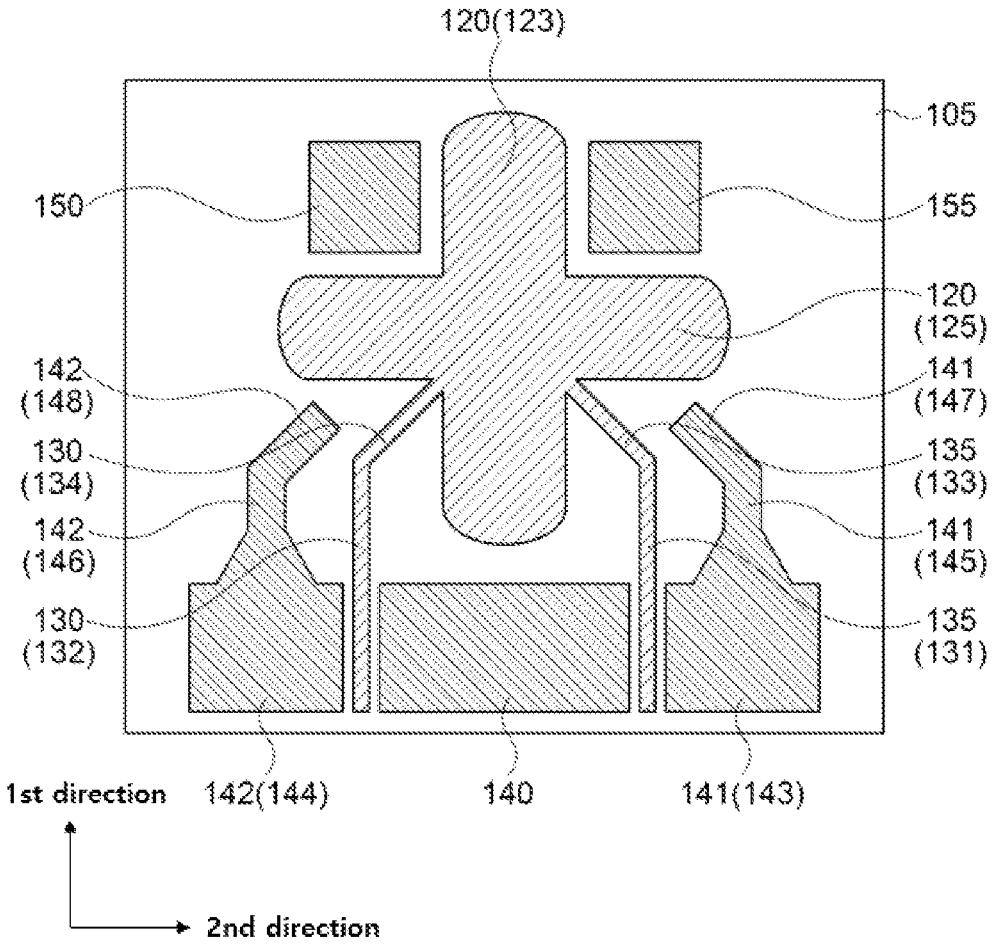

FIGS. 4 and 5 are schematic top planar views illustrating an antenna structure according to some exemplary embodiments. Detailed descriptions on elements and structures substantially the same as or similar to those described with reference to FIG. 1 are be omitted herein.

Referring to FIG. 4, the radiator 120 may have a cross shape. For example, the radiator 120 may include a first radiation bar 123 and a second radiation bar 125 extending in directions perpendicular to each other and intersecting each other. For example, the first radiation bar 123 may extend in the first direction, and the second radiation bar 125 may extend in the second direction.

A protrusion may be defined by the radiation bars 123 and 125, and a concave portion may be defined by a space between the radiation bars 123 and 125. The upper parasitic elements 150 and 155 are disposed to be adjacent to the concave portions included in the upper portion of the radiator 120, and may have, e.g., a rectangular shape.

Referring to FIG. 5, end portions of the first radiation bar 123 and the second radiation bar 125 may each have a curved shape.

As described above, the shape of the radiator 120 may be appropriately changed in consideration of radiation efficiency and multi-band generation efficiency, and is not limited to the shape of the embodiment illustrated in FIGS. 1 to 5.

In FIGS. 1 to 5, one radiator 120 and the parasitic elements and the transmission lines coupled thereto are illustrated as one antenna unit. However, the antenna structure 100 may include a plurality of the antenna units in an array form. For example, the antenna units may be repeatedly arranged along the second direction.

Figure 6:
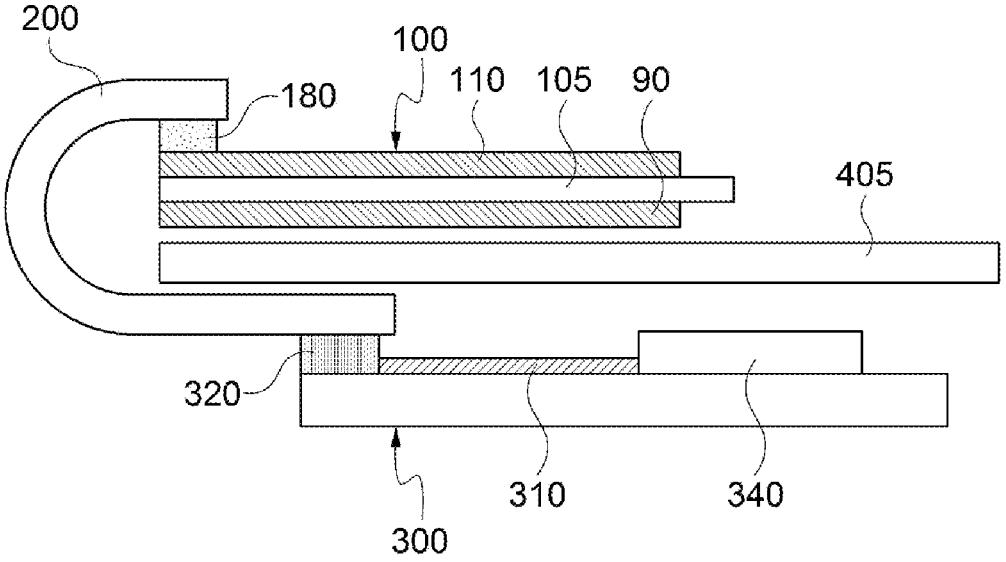
FIG. 6 is a schematic cross-sectional view illustrating an antenna package and an image display device according to exemplary embodiments.
Figure 8:
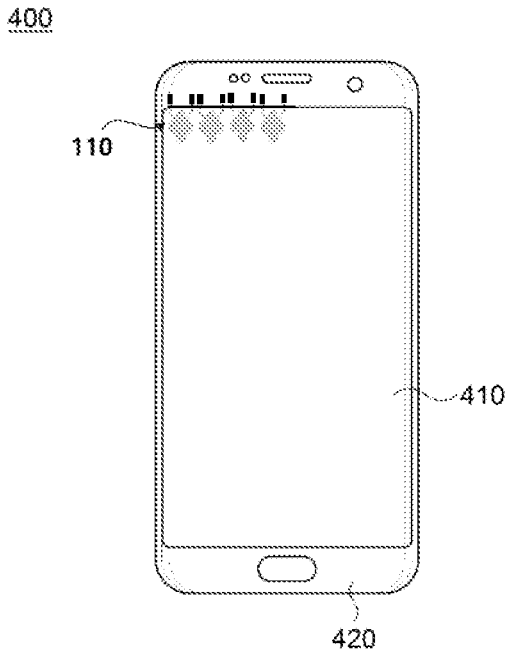
FIG. 8 is a schematic top planar view for describing an image display device according to exemplary embodiments.

FIG. 6 is a schematic cross-sectional view illustrating an antenna package and an image display device according to exemplary embodiments. FIG. 7 is a schematic partially enlarged top planar view for describing an antenna package according to exemplary embodiments. FIG. 8 is a schematic top planar view for describing an image display device according to exemplary embodiments.

Referring to FIGS. 6 to 8, an image display device 400 may be fabricated in the form of, e.g., a smart phone, and FIG. 8 illustrates a front portion or a window surface of the image display device 400. The front portion of the image display device 400 may include a display area 410 and a peripheral area 420. The peripheral area 420 may correspond to, e.g., a light-shielding area or a bezel area of the image display device.

As illustrated in FIG. 8, the antenna units included in the antenna conductive layer 110 may be included in the image display device 400 in an array. For convenience of descriptions, an illustration of the parasitic elements is omitted in FIG. 8.

The above-described antenna structure 100 may be combined with an intermediate circuit board 200 to form an antenna package. The antenna structure 100 included in the antenna package may be disposed toward the front portion of the image display device 400, and may be disposed on, e.g., a display panel 405. The radiator 120 may be disposed in the display area 410.

In this case, the radiator 120 may include a mesh structure, and a reduction of transmittance due to the radiator 120 may be prevented. The lower parasitic elements and the feeding portions included in the antenna structure 100 may include a solid metal pattern, and may be disposed in the peripheral area 420 to prevent an deterioration of an image quality.

In some embodiments, the intermediate circuit board 200 may be bent and disposed at a rear portion of the image display device 400 to extend to a chip mounting board 300 on which an antenna driving IC chip 340 is mounted.

The intermediate circuit board 200 and the chip mounting board 300 may be coupled to each other by a connector 320 to form an antenna package. The connector 320 and the antenna driving IC chip 340 may be electrically connected through the connection circuit 310.

For example, the intermediate circuit board 200 may be a flexible printed circuit board (FPCB). The chip mounting board 300 may be a rigid printed circuit board (Rigid PCB).

As illustrated in FIG. 7, the intermediate circuit board 200 may include a core layer 210 including a flexible resin and feeding lines 220 formed on the core layer 210. Each of the feeding lines 220 may be attached and electrically connected to the first feeding portion 132 and the second feeding portion 131 through a conductive intermediate structure 180 (see FIG. 6) such as an anisotropic conductive film (ACF).

End portions of the first feeding portion 132 and the second feeding portion 131 bonded to the feeding lines 220 may be provided as a first antenna port and a second antenna port, respectively. A feeding signal may be applied from the antenna driving IC chip 340 through the first antenna port and the second antenna port.

As described above, the feeding signals having a phase difference (e.g., a phase difference of 180°) may be applied to the radiator 120 through the first antenna port and the second antenna port to implement a multi-band antenna.

Figure 9:
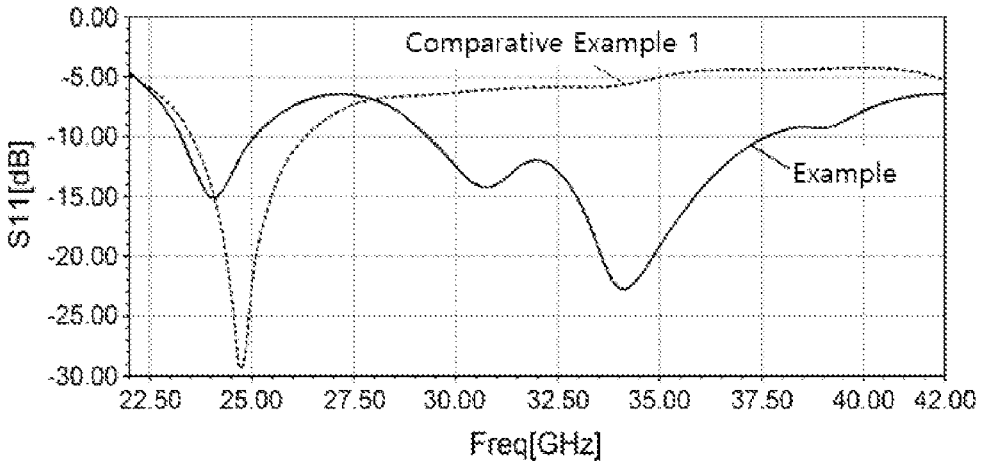
FIGS. 9 to 11 are graphs showing radiation properties of antenna structures according to Examples and Comparative Examples.
Figure 10:
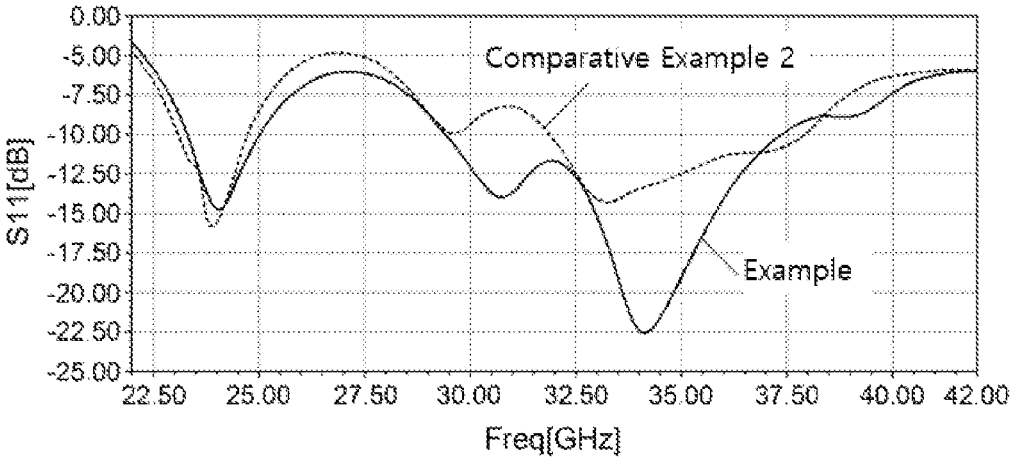
Figure 11:
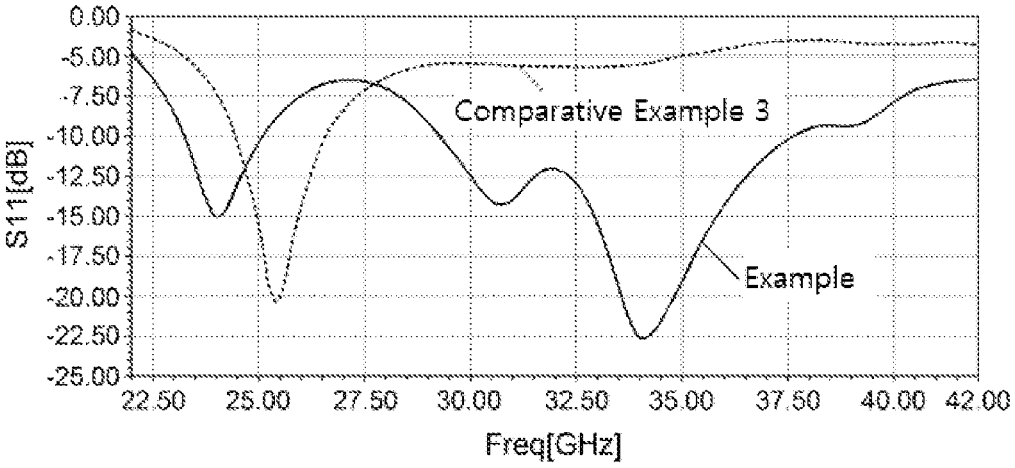

FIGS. 9 to 11 are graphs showing radiation properties of antenna structures according to Examples and Comparative Examples.

Specifically, Example indicates a graph in which a signal loss (S-parameter; S11) according to a frequency change was simulated using an HFSS (High Frequency Structure Simulator) from the antenna structure formed to have the same structure as that illustrated in FIG. 1.

Comparative Example 1 indicates a simulation graph in a case where all parasitic elements were omitted from the structure of Example. Comparative Example 2 indicates a simulation graph in a case where the upper parasitic element was omitted from the structure of Example. Comparative Example 3 indicates a simulation graph in a case where the lower parasitic elements (the central parasitic element and the lateral parasitic element) were omitted from the structure of Example.

As commonly shown in FIGS. 9 to 11, three resonance peaks were observed in Example. However, as shown in FIG. 9, only one resonance peak around 25 GHz was observed in Comparative Example 1.

As shown in FIG. 10, the upper parasitic element was omitted in Comparative Example 2, and an overall S11 property was deteriorated, and a frequency shift occurred toward a low frequency.

As shown in FIG. 11, the lower parasitic element was omitted in Comparative Example 3, and only one resonance peak was observed around 25 GHz.

As shown in FIGS. 9 to 11, the upper and lower parasitic elements were combined in the radiator/transmission line structure according to exemplary embodiments, so that a substantial triple-band antenna structure having sufficient signal strength and resonance property was implemented.

What is claimed is:

1. An antenna structure, comprising:

a dielectric layer; and an antenna conductive layer disposed on a top surface of the dielectric layer, wherein the antenna conductive layer comprises:

a radiator;

first and second transmission lines extending in different directions to be connected to the radiator;

an upper parasitic element adjacent to an upper portion of the radiator in a planar view; and a lower parasitic element adjacent to a lower portion of the radiator, the first transmission line and the second transmission line in the planar view, wherein the radiator has convex portions and concave portions, and the first transmission line and the second transmission line are connected to different concave portions of the concave portions.

2. The antenna structure of claim 1, wherein the first transmission line comprises a first feeding portion and a first bent portion extending from the first feeding portion to be connected to the radiator; and the second transmission line comprises a second feeding portion and a second bent portion extending from the second feeding portion to be connected to the radiator.

3. The antenna structure of claim 2, wherein an angle between the first bent portion and the second bent portion is 90°.

4. The antenna structure of claim 2, wherein the first feeding portion and the second feeding portion serve as antenna ports to which feeding signals of different phases are applied.

5. The antenna structure of claim 4, wherein a phase difference between the feeding signals applied to the first feeding portion and the second feeding portion is from 160° to 200°.

6. The antenna structure of claim 1, wherein the upper parasitic element comprises a first upper parasitic element and a second upper parasitic element separated from each other.

7. The antenna structure of claim 6, wherein the radiator has convex portions and concave portions; and the first upper parasitic element and the second upper parasitic element are disposed to be adjacent to different concave portions of the concave portions.

8. The antenna structure of claim 7, wherein the first upper parasitic element and the second upper parasitic element face each other with a convex portion at the upper portion of the radiator among the convex portions interposed therebetween.

9. The antenna structure of claim 1, wherein the lower parasitic element comprises a first lateral parasitic element adjacent to the first transmission line, and a second lateral parasitic element adjacent to the second transmission line.

10. The antenna structure of claim 9, wherein the lower parasitic element further comprises a central parasitic element disposed between the first transmission line and the second transmission line; and the first lateral parasitic element is separated from the central parasitic element with the first transmission line interposed therebetween, and the second lateral parasitic element is separated from the central parasitic element with the second transmission line interposed therebetween.

11. The antenna structure of claim 10, wherein the first lateral parasitic element comprises:

a first parasitic body facing the central parasitic element with the first transmission line interposed therebetween;

a first parasitic extension portion protruding from the first parasitic body; and a first parasitic bent portion extending from the first parasitic extension portion toward the radiator, wherein the second lateral parasitic element comprises:

a second parasitic body facing the central parasitic element with the second transmission line interposed therebetween;

a second parasitic extension portion protruding from the second parasitic body; and a second parasitic bent portion extending from the second parasitic extension portion toward the radiator.

12. The antenna structure of claim 11, wherein the radiator has a mesh structure; and the central parasitic element, the first parasitic body and the second parasitic body have a solid structure.

13. The antenna structure of claim 12, wherein a portion of the first transmission line between the central parasitic element and the first parasitic body has a solid structure, and a remaining portion of the first transmission line has a mesh structure; and a portion of the second transmission line between the central parasitic element and the second parasitic body has a solid structure, and a remaining portion of the second transmission line has a mesh structure.

14. The antenna structure of claim 11, wherein the radiator has a mesh structure; and each of the central parasitic element, the first parasitic body and the second parasitic body includes a mesh portion and a solid portion.

15. An antenna structure comprising:

a dielectric layer; and an antenna conductive layer disposed on a top surface of the dielectric layer, wherein the antenna conductive layer comprises:

a radiator;

first and second transmission lines extending in different directions to be connected to the radiator;

an upper parasitic element adjacent to an upper portion of the radiator in a planar view; and a lower parasitic element adjacent to a lower portion of the radiator, the first transmission line and the second transmission line in the planar view, wherein the radiator has a four-leaf clover shape or a cross shape.

16. The antenna structure of claim 1, wherein the radiator, the first transmission line, the second transmission line, the upper parasitic element and the lower parasitic element are all arranged at the same level on the top surface of the dielectric layer.

17. An image display device, comprising:

a display panel; and the antenna structure of claim 1 disposed on the display panel.

18. The image display device of claim 17, further comprising:

an intermediate circuit board comprising feeding lines electrically connected to the first transmission line and the second transmission line of the antenna structure;

a chip mounting board disposed under the display panel; and an antenna driving integrated circuit chip mounted on the chip mounting board to apply a feeding signal to the feeding lines included in the intermediate circuit board.

* * * * *